US007344399B2

(12) United States Patent
Iijima et al.

(10) Patent No.: US 7,344,399 B2
(45) Date of Patent: Mar. 18, 2008

(54) FLAT CIRCUIT CONNECTOR

(75) Inventors: Hideki Iijima, Machida (JP); Yoshiteru Nogawa, Machida (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/575,323

(22) PCT Filed: Oct. 12, 2004

(86) PCT No.: PCT/US2004/033636

§ 371 (c)(1),
(2), (4) Date: Dec. 19, 2006

(87) PCT Pub. No.: WO2005/038992

PCT Pub. Date: Apr. 28, 2005

(65) Prior Publication Data

US 2007/0212916 A1 Sep. 13, 2007

(30) Foreign Application Priority Data

Oct. 16, 2003 (JP) ..... 2003-356043

(51) Int. Cl.
*H01R 13/15* (2006.01)

(52) U.S. Cl. ..... 439/260

(58) Field of Classification Search ..... 439/260, 439/495

See application file for complete search history.

(56) References Cited

U.S. PATENT DOCUMENTS 5,906,498 A * 5/1999 Nagafuji ..... 439/260
6,726,497 B2 * 4/2004 Nogawa et al. ..... 439/260
6,761,573 B1 * 7/2004 Chiu ..... 439/260
7,044,773 B2 * 5/2006 Suzuki et al. ..... 439/495
7,255,584 B2 * 8/2007 Takashita ..... 439/260
7,261,588 B2 * 8/2007 Yokoyama ..... 439/495
7,270,567 B2 * 9/2007 Inoue ..... 439/495
7,275,948 B2 * 10/2007 Miura et al. ..... 439/260
2002/0045374 A1 * 4/2002 Kunishi et al. ..... 439/260
2002/0115327 A1 * 8/2002 Yamane ..... 439/260
2003/0087544 A1 * 5/2003 Nogawa et al. ..... 439/260
2004/0023551 A1 * 2/2004 Suzuki et al. ..... 439/495
2005/0255732 A1 * 11/2005 Sunaga ..... 439/260
2006/0084311 A1 * 4/2006 Suzuki et al. ..... 439/260
2006/0089036 A1 * 4/2006 Takai et al. ..... 439/260
2006/0205257 A1 * 9/2006 Suzuki et al. ..... 439/260

(Continued)

*Primary Examiner*—Ross Gushi
(74) *Attorney, Agent, or Firm*—Charles S. Cohen

(57) ABSTRACT

An electrical connector (22) is provided for terminating a flat electrical circuit (24) to a printed circuit board. The connector includes a dielectric housing (26) having an opening (28) for receiving an end of the flat circuit. A, plurality of terminals are mounted on the housing in a side-by-side array and are spaced along the opening. Some of the terminals have mounting sections (32*a*) for fixing the terminal in the dielectric housing. Each such terminal includes a tail section (32*b*) projecting from one end of the mounting, section outside the housing for connector to an appropriate circuit trace on the printed circuit board. A flexible contact arm (32*c*) projects from an opposite end of the mounting section into the opening. An actuator section (32*e*) is disposed between the flexible contact arm and the mounting section. An actuator (30) is movably mounted on the housing for movement between and open position allowing the flat circuit to be inserted into the opening and a closed position in engagement with the actuator sections of the terminals to bias the flexible contact arms into engagement with the flat circuit.

16 Claims, 9 Drawing Sheets

U.S. PATENT DOCUMENTS

2006/0270270 A1* 11/2006 Yokoyama ..... 439/495
2006/0286843 A1* 12/2006 Fukazawa ..... 439/260
2007/0049087 A1* 3/2007 Hashimoto et al. ..... 439/260
2007/0087605 A1* 4/2007 Suzuki et al. ..... 439/260
2007/0093122 A1* 4/2007 Kudo et al. ..... 439/495
2007/0117451 A1* 5/2007 Yokoyama ..... 439/495
2007/0141897 A1* 6/2007 Miura et al. ..... 439/495
2007/0202736 A1* 8/2007 Takashita ..... 439/495

* cited by examiner

FLAT CIRCUIT CONNECTOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals.

One of the problems with flat circuit connectors of the character described above, is that when an excessive withdrawal force is placed or pulled on the flat circuit, the actuator can possibly rotate and inadvertently release the flat circuit from the connector. The present invention is directed to solving this and other problems of the prior art.

Examples of such prior art flat circuit connectors are shown in Japanese Patent Application Laid-Open No. 2002-190,360; Japanese Patent Application Laid-Open No. 2003-45,581; and Japanese Utility Model Application Laid-Open 3-103,578.

FIG. 21 shows a prior art flat circuit connector, generally designated 22, which includes a dielectric housing, generally designated 24, which mounts a plurality of laterally spaced terminals 26. An actuator, generally designated 28, is pivotally mounted on the housing for movement between an open position (shown in phantom) allowing a flat circuit to be inserted into a slot 30 of the housing and a closed position (shown in full lines) biasing flexible contact arms 26*a* of the terminals against the flat circuit. Each terminal 26 includes a generally horizontal base portion 26*b* which is fixed within a passage 32 of the housing. The flexible contact arm is joined to the base by an upright joint section 26*c* of the terminal. An actuator section 26*d* extends rearwardly of the joint section versus the forwardly extending direction of flexible contact arm 26*a*. Rotation of the actuator from its open position to its closed position pushes upwardly on actuator section 26*b* which, in turn, pushes downwardly on flexible contact arm 26*a* as joint section 26*c* acts as a "teeter" or fulcrum.

SUMMARY OF THE INVENTION

An object, therefore, of the invention is to provide a new and improved electrical connector for terminating a flat electrical circuit, such as connecting a flat electrical circuit to a printed circuit board.

In the exemplary embodiment of the invention, the connector includes a dielectric housing having an opening for receiving an end of the flat circuit. A plurality of terminals are mounted on the housing in a side-by-side array and are spaced along the opening. At least some of the terminals comprise flexible contact terminals which have mounting sections for fixing the terminal in the dielectric housing. Each such terminal includes a tail section projecting from one end of the mounting section outside the housing for connection to an appropriate circuit trace on the printed circuit board. A flexible contact arm projects from an opposite end of the mounting section into the opening. An actuator section is disposed between the flexible contact arm and the mounting section. An actuator is movably mounted on the housing for movement between and open position allowing the flat circuit to be inserted into the opening and a closed position in engagement with the actuator portions of the flexible contact terminals to bias the flexible contact arms into engagement with the flat circuit.

According to one aspect of the invention, other of said terminals comprise pivot/cam terminals having pivot means to mount the actuator for pivotal movement between the open and closed positions. The pivot/cam terminals have a cam surface for engaging a cam portion of the actuator to provide a back-up as the cam portion biases the flexible contact arms against the flat circuit. In the preferred embodiment, the pivot means of the pivot/cam terminals comprise a pivot socket for receiving the cam portion of the actuator and pivotally mounting the actuator for movement between the open and closed positions.

According to another aspect of the invention, the pivot socket of each pivot/cam terminal has an open mouth to allow the cam portion of the actuator to be inserted thereinto when the actuator is assembled to the housing in its open position. The terminals which have the flexible contact arms include blocking portions to prevent the cam portion of the actuator from pulling out of the pivot socket when the actuator is in its closed position. In the preferred embodiment, the cam portion has a narrow dimension in cross-section and a wide dimension generally perpendicular to the narrow dimension. Therefore, the narrow dimension can pass through the mouth of the pivot socket when the actuator is in its open position. The blocking portions of the flexible contact terminals prevent the wide dimension from moving out of the mouth when the actuator is in its closed position.

According to a further aspect of the invention, the flexible contact arms of the flexible contact terminals engage one side of the flat circuit. The pivot/cam terminals include generally rigid contact arms for engaging an opposite side of the flat circuit, along with tail portions for connection to appropriate circuit traces on the printed circuit board. In the preferred embodiment, the pivot/cam terminals are rigidly mounted at a bottom of the housing such that the rigid contact arms are engageable with a bottom side of the flat circuit. The flexible contact terminals are mounted on the housing with the flexible contact arms located at a top of the housing for engaging a top side of the flat circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1A:
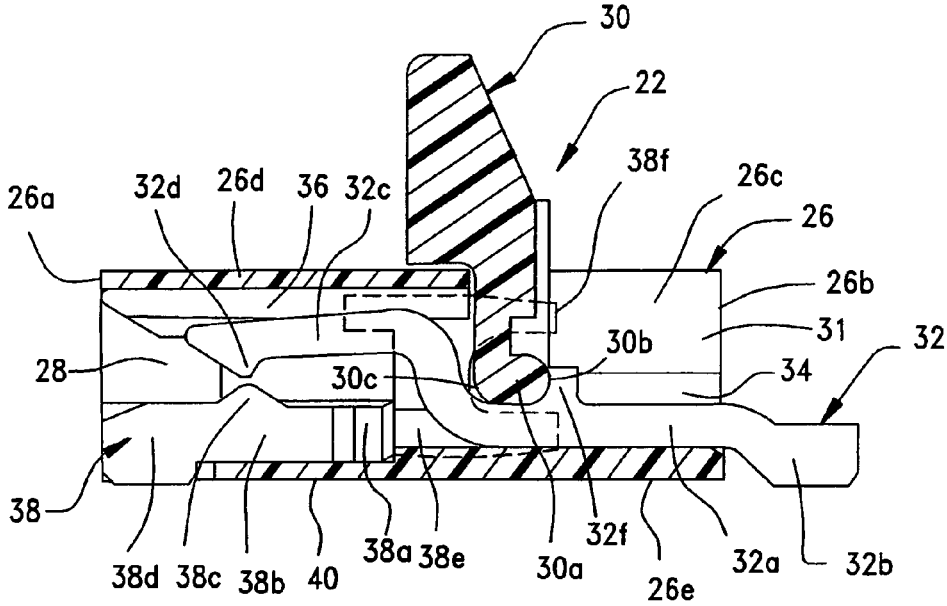
FIG. 1*a* is a front-to-rear vertical section through a flat circuit connector according to a first embodiment of the invention, with the actuator in its open position and showing one of the flexible contact terminals.

Referring to the drawings in greater detail, and first to FIGS. 1*a*-5, one embodiment of the invention is shown in a flat circuit connector, generally designated 22, for connecting a flat electrical circuit (24 in FIGS. 14 and 15) to a printed circuit board (not shown). The connector includes an insulating or dielectric housing, generally designated 26, which includes a front mating end 26*a* and a rear terminating end 26*b*. The housing has a slot or opening 28 in the front mating end thereof for receiving an end of the flat circuit. An actuator, generally designated 30, is movably mounted on the housing for pivotal movement between an open position (FIGS. 1*a,* 1*b,* 3 and 4) allowing the flat circuit to be inserted into opening 28 and a closed position (FIGS. 2*a,* 2*b* and 5) biasing some of the terminals of the connector against the flat circuit, as described hereinafter. The actuator is movable into and out of an actuator accommodating space 31 between a pair of side walls 26*c* at the rear of the housing. The housing further has a top wall 26*d* above opening 28 and a bottom wall 26*e* for mounting on top of the printed circuit board.

Figure 6:
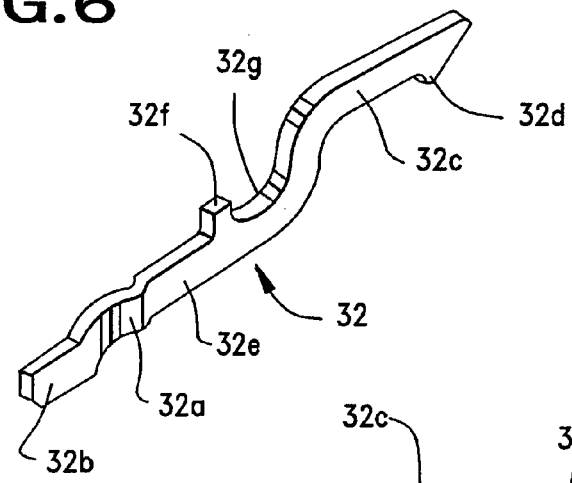
FIG. 6 is a perspective view of one of the flexible contact terminals.
Figure 7:
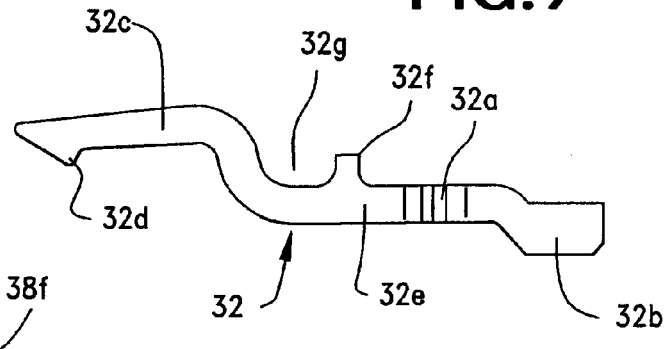
FIG. 7 is a side elevational view of one of the flexible contact terminals.

Generally, a plurality of terminals are mounted on housing 26 in a side-by-side array and are spaced along opening 28. Specifically, and referring to FIGS. 6 and 7 in conjunction with FIGS. 1*a* and 2*a,* some of the terminals comprise flexible contact terminals, generally designated 32. Each contact terminal 32 includes a mounting section 32*a* for fixing the terminal in a narrow groove 34 opening at the rear of the housing. The mounting section is rounded, as can be seen in FIG. 6, to press-fit the terminal in the narrow groove. Each contact terminal includes a tail section 32*b* which projects outside housing 26 as seen in FIG. 1*a* for connection to an appropriate circuit trace on the printed circuit board. Each contact terminal includes a flexible contact arm 32*c* which projects forwardly into opening 28. The flexible contact arm is disposed in a groove 36 beneath top wall 26*b* of the housing and includes a downwardly projecting contact point 32*d* for engaging the top of the flat circuit. Each contact terminal 32 includes an actuator section 32*e* between the flexible contact arm and mounting section 32*a*. Each contact terminal includes a blocking portion 32*f* projecting upwardly from a front end of actuator section 32*e* and defines a recess 32*g* in front of the locking portion.

Figure 1B:
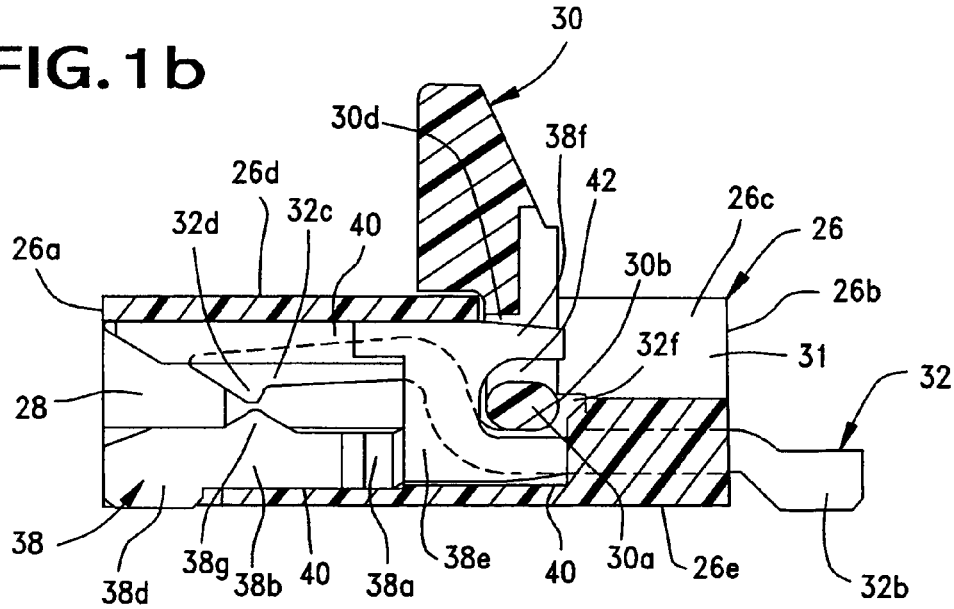
FIG. 1*b* is a view similar to that of FIG. 1*a,* but taken at a position to show one of the pivot/cam terminals.
Figure 2A:
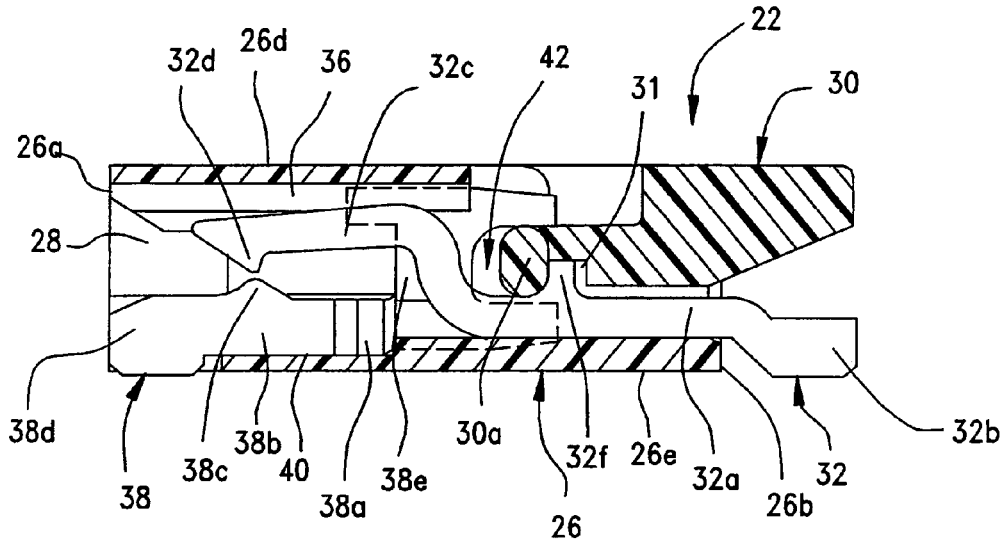
FIGS. 2*a* and 2*b* are views similar to that of FIGS. 1*a* and 1*b,* respectively, but with the actuator in its closed position.
Figure 2B:
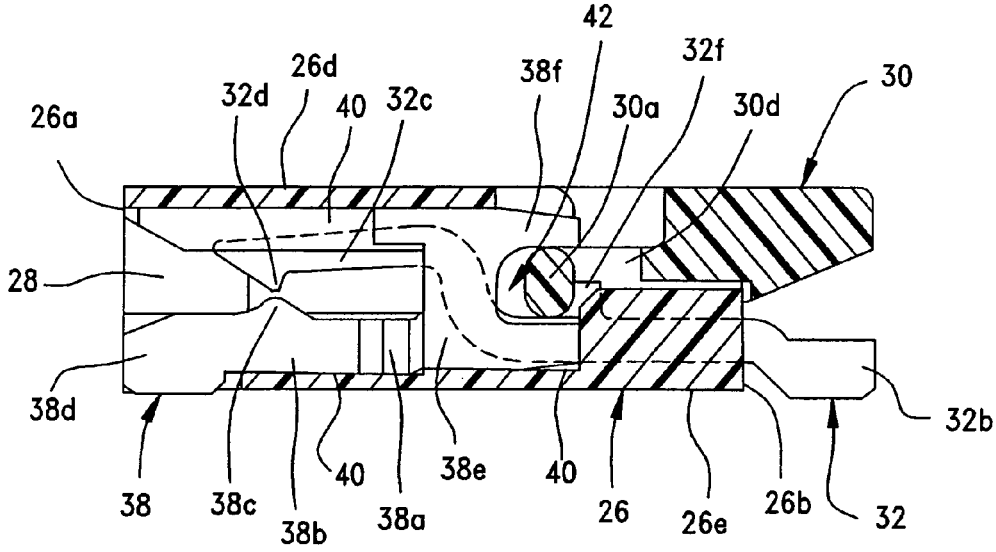
Figure 3:
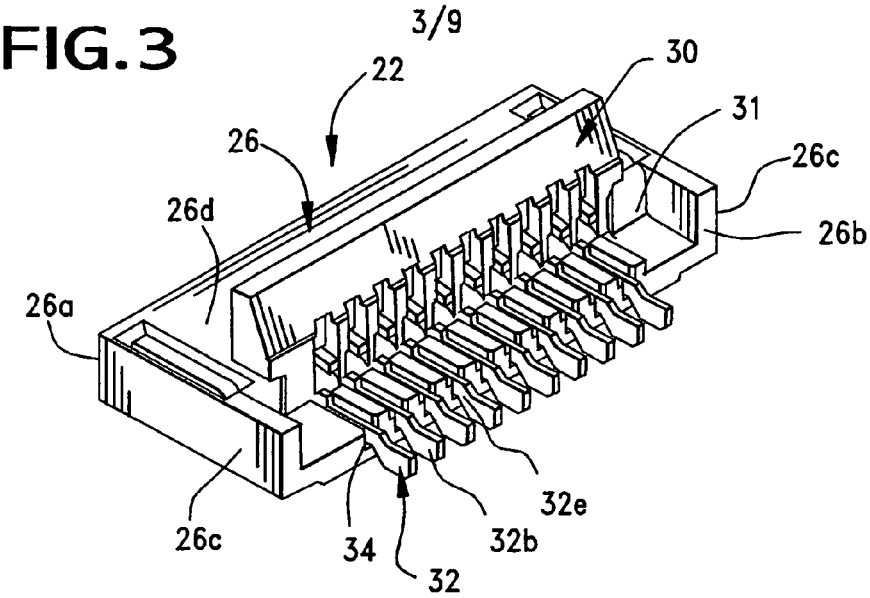
FIG. 3 is a rear perspective view of the connector, with the actuator in its open position.
Figure 4:
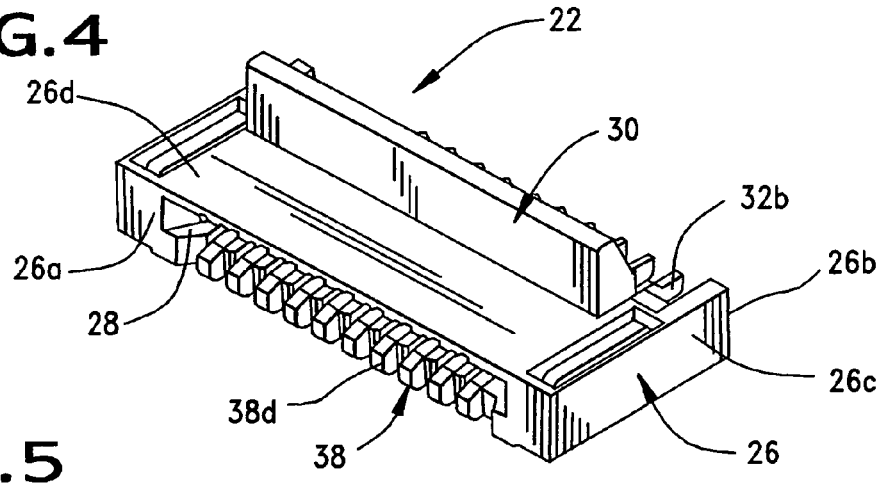
FIG. 4 is a front perspective of the connector, with the actuator in its open position.
Figure 5:
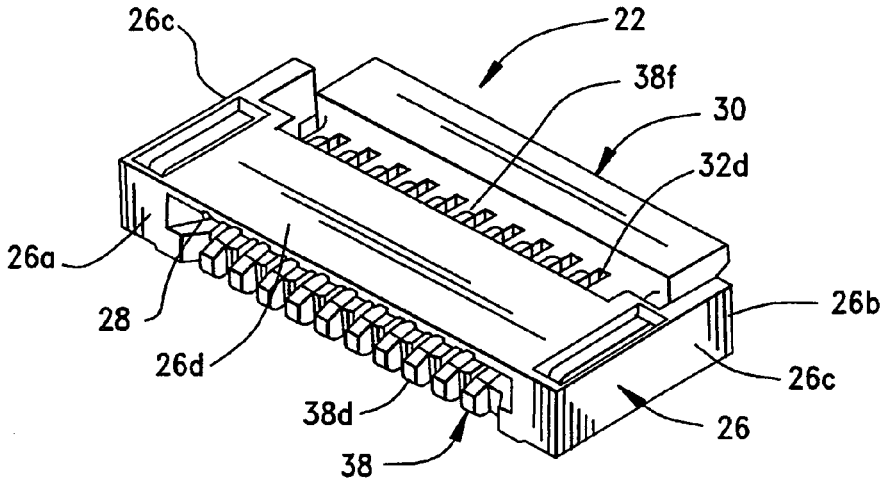
FIG. 5 is a view similar to that of FIG. 4, with the actuator in its closed position.
Figure 8:
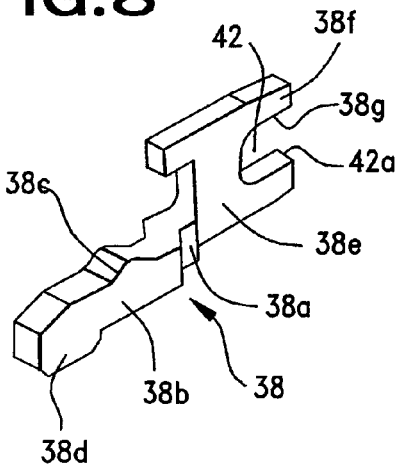
FIG. 8 is a perspective view of one of the pivot/cam terminals.
Figure 9:
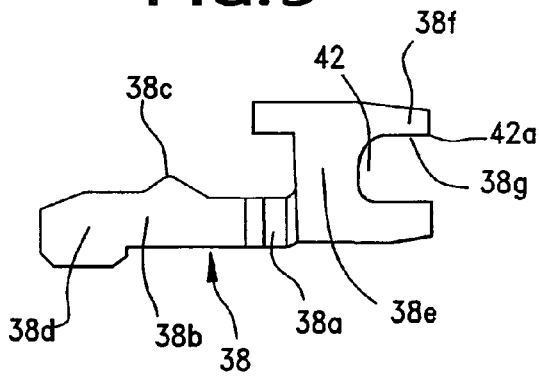
FIG. 9 is a side elevational view of one of the pivot/cam terminals.

Referring to FIGS. 8 and 9 in conjunction with FIGS. 1*b* and 2*b,* a plurality of pivot/cam terminals, generally designated 38, are mounted within groove 40 in the housing above bottom wall 26*e* thereof. Each pivot/cam terminal 38 includes a mounting section 38*a* for fixing the terminal within groove 40. A rigid contact arm 38*b* projects forwardly of the mounting section and includes a contact point 38*c* projecting upwardly into opening 28 for engaging the bottom of the flat circuit. A tail portion 38*d* projects forwardly of contact arm 38*b* for connection to an appropriate circuit trace on the printed circuit board. A rear pivot/cam section 38*e* projects rearwardly of mounting section 38*a* and includes a rearwardly opening pivot socket 42 having a rear mouth 42*a*. The top of the pivot socket is defined by a cam arm 38*f* of rear section 38*e*. The cam arm defines a bottom cam surface 38*g*.

Figure 10:
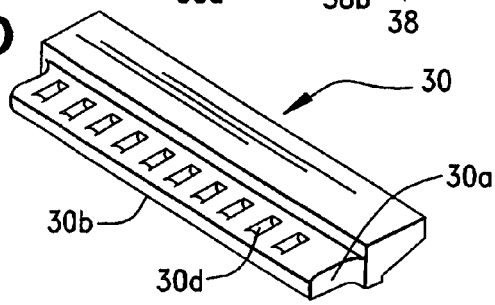
FIG. 10 is a top perspective view of the actuator.
Figure 11:
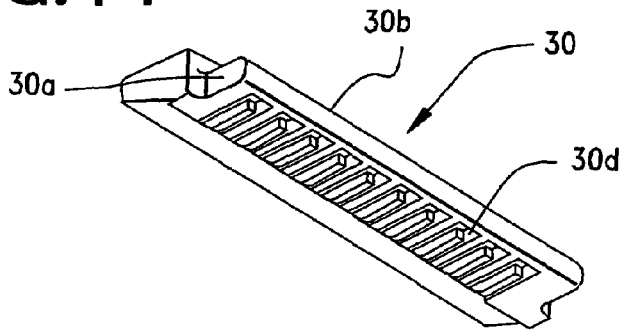
FIG. 11 is a bottom perspective view of the actuator.

Referring to FIGS. 10 and 11 in conjunction with FIGS. 1*a*-2*b,* actuator 30 includes a rounded pivot portion 30*a* which is generally oblong as seen in FIGS. 1*a*-2*b* to define a narrow dimension in cross-section and a wide dimension generally perpendicular to the narrow dimension. The cam portion has a first cam surface 30*b* and a second cam surface 30*c* at opposite sides of the cam portion in the wide dimension thereof. Cam portion 30*a* also has a plurality of windows 30*d* for accommodating cam arms 38*f* of terminals 38 as can be seen clearly in FIG. 1*b*.

Figure 12:
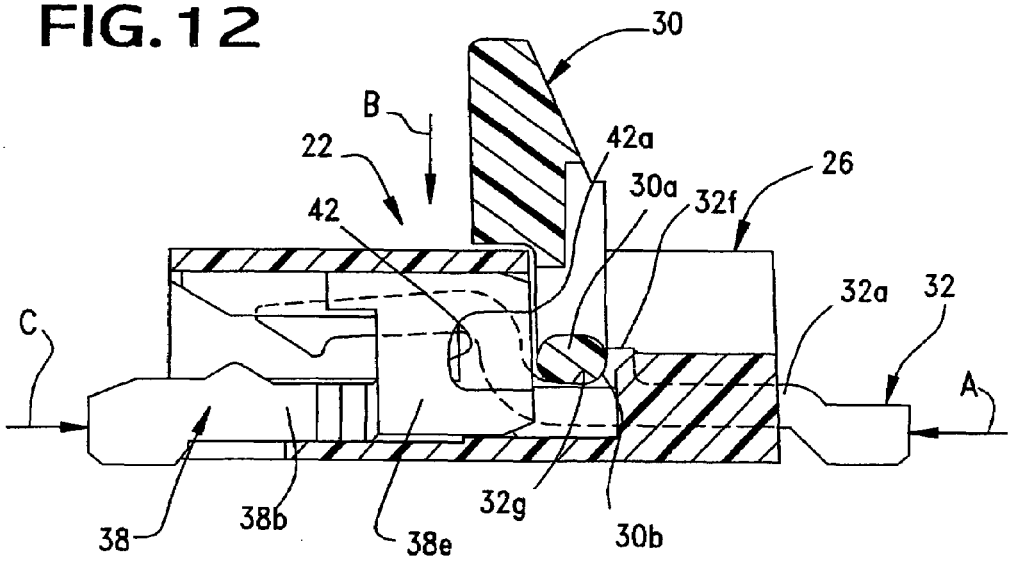
FIGS. 12 and 13 are sequential sectional views showing the assembly of one of the pivot/cam terminals into the connector housing.
Figure 13:
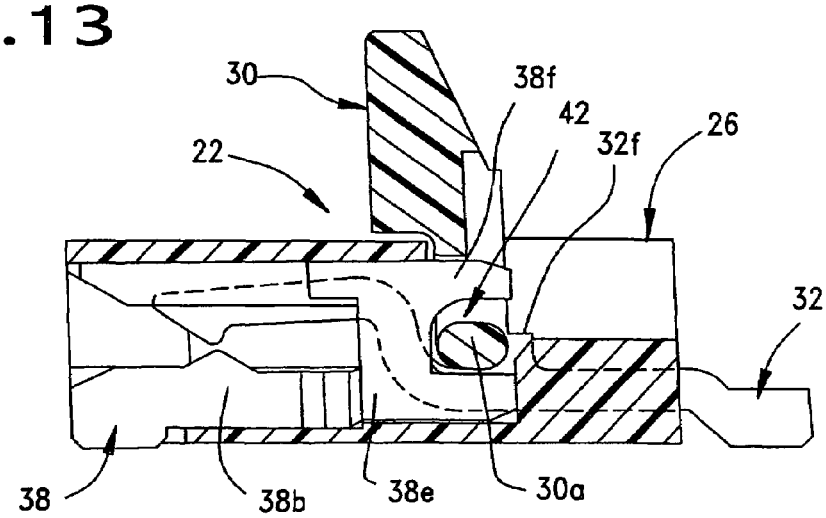

FIGS. 12 and 13 show the basic assembly of flat circuit connector 22. Specifically, contact terminals 32 first are inserted in the direction of arrow "A" (FIG. 2) into the grooves 34 (FIG. 1*a*) of the housing until the contact terminals are fixed in position, as shown. Actuator 30 then is assembled downwardly in the direction of arrow "B": i.e., in the normally open position of the actuator. Cam portion 30*a* of the actuator enters recessed 32*g* (FIGS. 6 and 7) of the contact terminals behind locking portions 32*f* of the terminals. The pivot/cam terminals then are inserted into grooves 39 and 40 (FIG. 1*b*) of the housing to the position shown in FIG. 13 as cam portion 30*a* passes through mouths 42*a* and into pivot sockets 42 of terminals 38 to the position also shown in FIG. 13. Locking portions 32*f* of contact terminals 32 lock the cam portions and prevent the cam portions from moving out of pivot sockets 42, particularly when the actuator is in its closed position.

Figure 14:
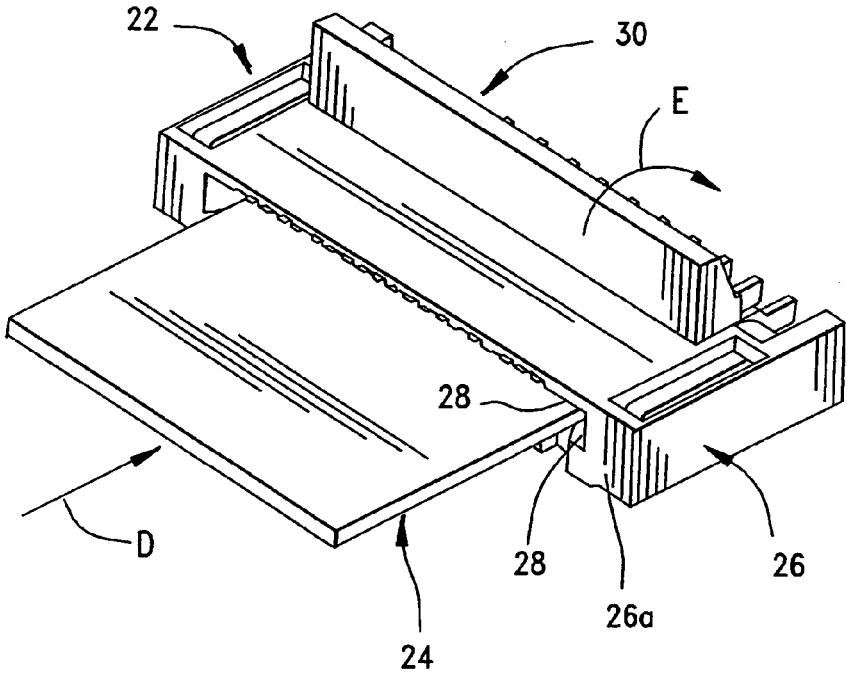
FIGS. 14 and 15 are enlarged views similar to that of FIGS. 4 and 5, but showing the insertion of a flat circuit into the connector.
Figure 15:
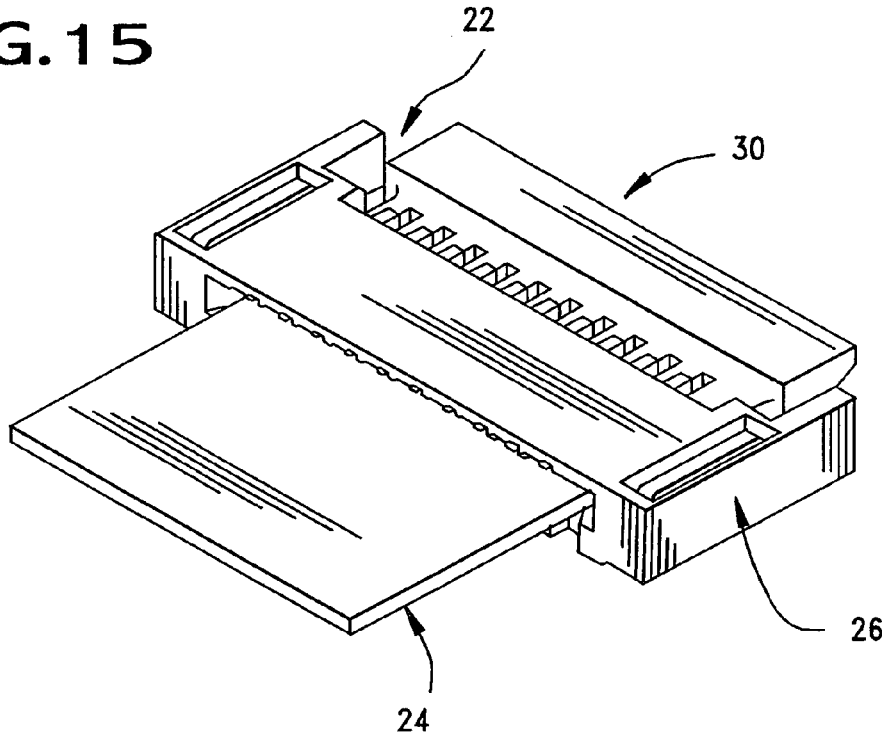
Figure 16A:
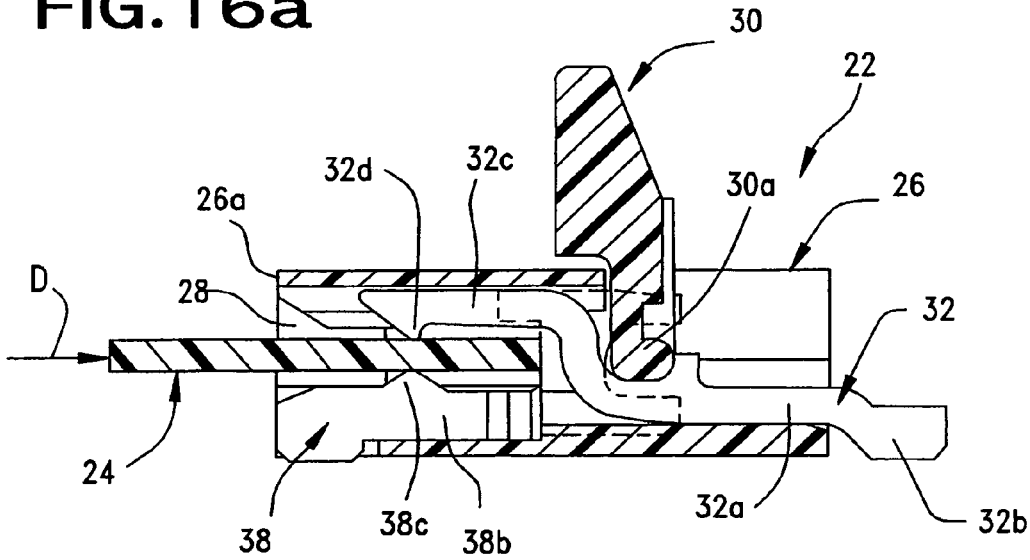
FIGS. 16*a*-18*b* are sequential views showing the operation of the connector in conjunction with a flat circuit.
Figure 16B:
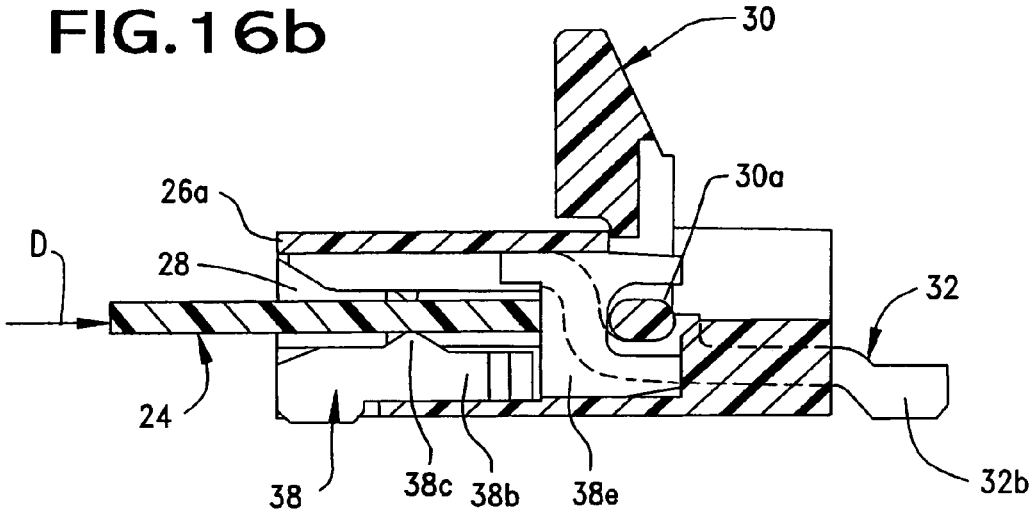

FIGS. 14 and 15 show flat circuit 24 inserted into flat circuit connector 22. In FIG. 14, actuator 30 is shown in its open position allowing flat circuit 24 to be inserted into opening 28 in the direction of arrow "D". Once fully inserted, the actuator is pivoted downwardly in the direction of arrow "E" to its closed position shown in FIG. 15, whereat the cam portion of the actuator biases flexible contact arms 32*c* and contact points 32*d* of contact terminals 32 into engagement with the top of the flat circuit, as will be described in greater detail below.

FIGS. 16*a*-18*b* show the sequence of operation of flat circuit connector 22 in conjunction with an inserted flat circuit 24. Specifically, FIGS. 16*a* and 16*b* correspond to the open position of actuator 30 described above in relation to FIG. 14. In the open position of the actuator, flexible contact arms 32*c* of contact terminals 32 are in their unstressed positions, with contact points 32*d* on the flexible contact arms spaced a sufficient distance from contact points 32*c* of the pivot/cam terminals 38 to allow flat circuit 24 to be inserted into opening 28 in the direction of arrow "D".

Figure 17A:
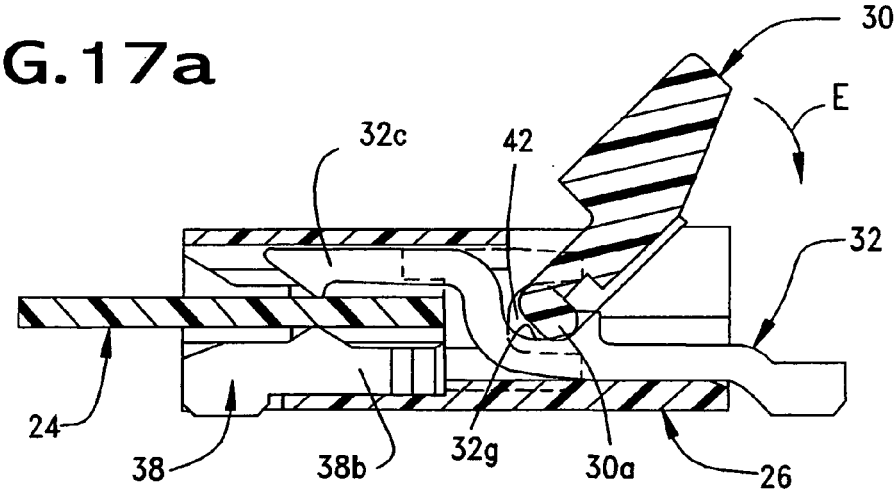
Figure 17B:
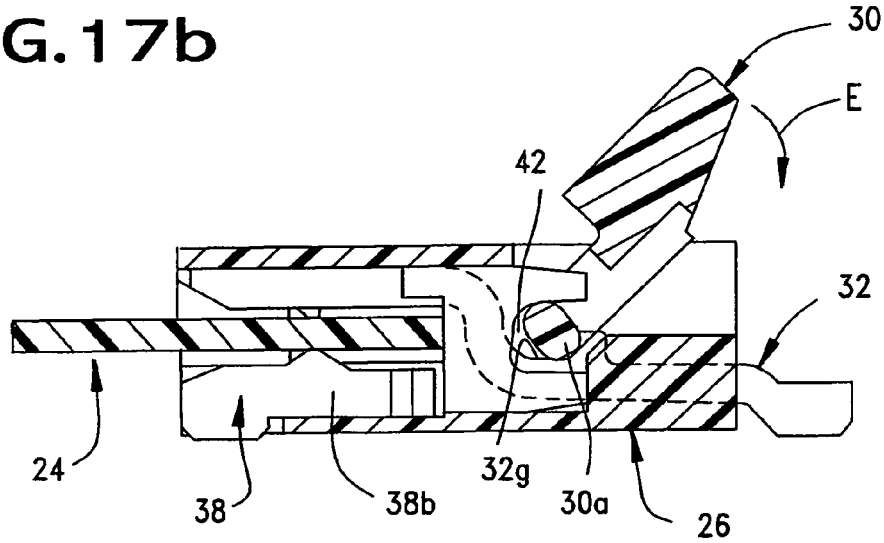

When flat circuit 24 is fully inserted into abutment with the front edges of the pivot/cam sections 38*e*, actuator 30 is pivoted downwardly in the direction of arrows "E" as shown in FIGS. 17*a* and 17*b*. Cam portion 30*a* of the actuator rotates or pivots within pivot socket 42 of the pivot/cam terminals 38 and within recess 32*g* of contact terminals 32.

Figure 18A:
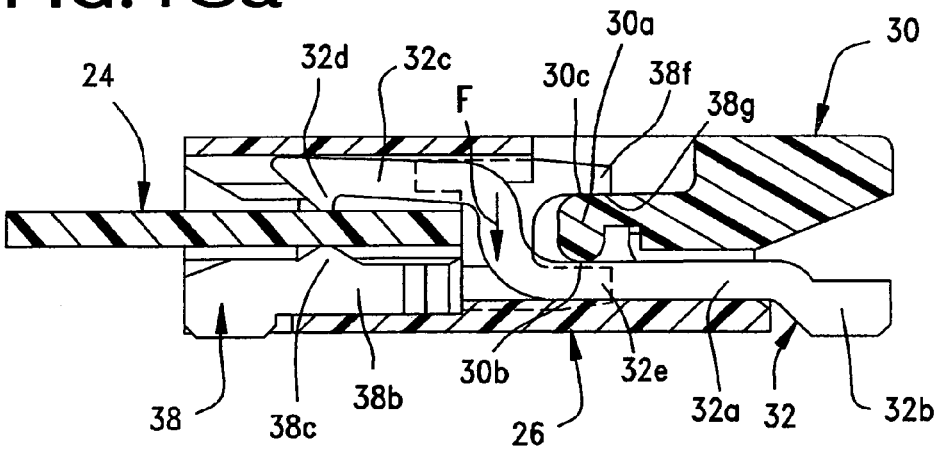
Figure 18B:
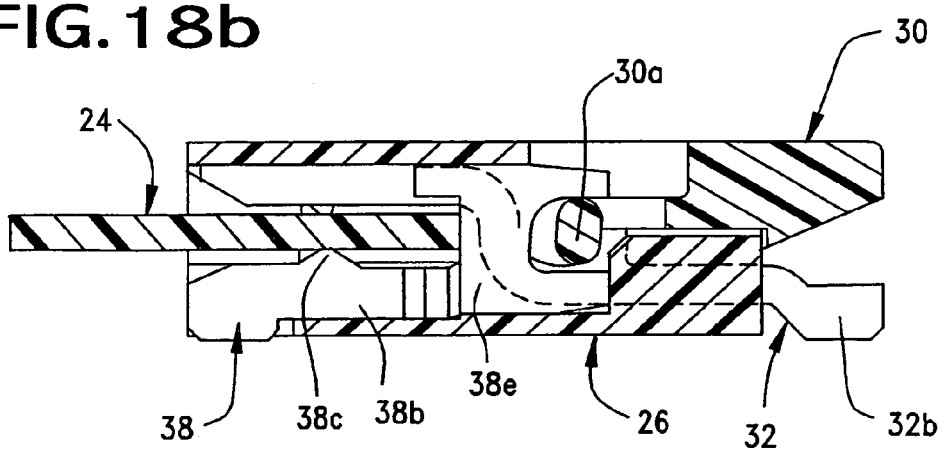

Actuator 30 is pivoted downwardly until it reaches its closed position shown in FIGS. 18*a* and 18*b*. In the closed position of the actuator, first cam surface 30*b* of cam portion 30*a* pushes downwardly on actuator sections 32*e* of contact terminals 32 in the direction of arrow "F" (FIG. 18*a*). This flexes the flexible contacts arms 32*c* of the contact terminals 32 downwardly to push contact points 32*d* into engagement with appropriate contacts on the top of flat circuit 24. This biasing force, in turn, pushes the bottom side of the flat circuit (and the contacts thereon) into engagement with contact points 38*c* which project upwardly from contact arms 38*b* of the pivot/cam terminals 38. During this camming action, the second contact surface 30*c* of cam portion 30*a* engages the bottom cam surfaces 38*g* of cam arms 38*f* of the pivot/cam terminals to provide a back-up or "anvil" for the cam portion of the actuator.

Figure 19:
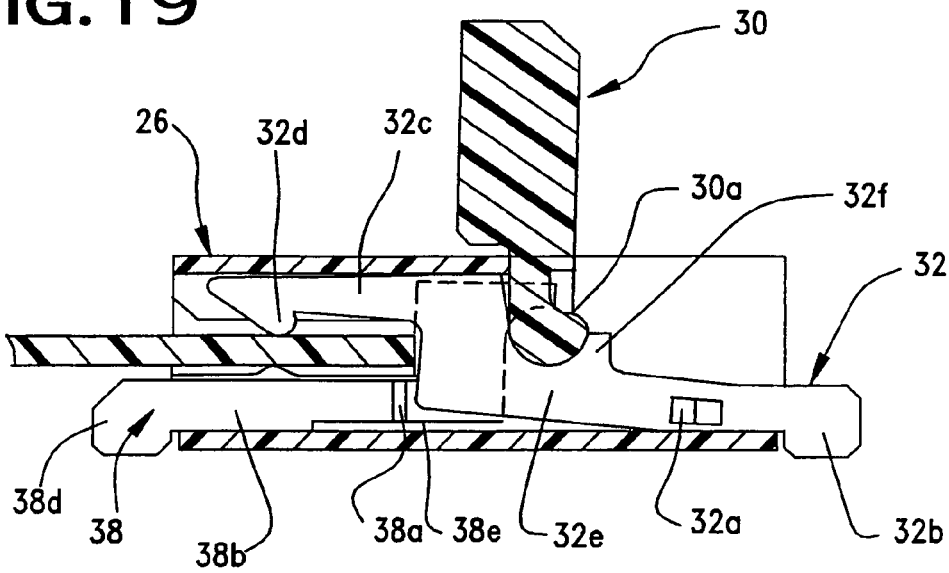
FIGS. 19 and 20 are sectional views showing the actuator in its open and closed positions, respectively, according to a second embodiment of the invention.
Figure 20:
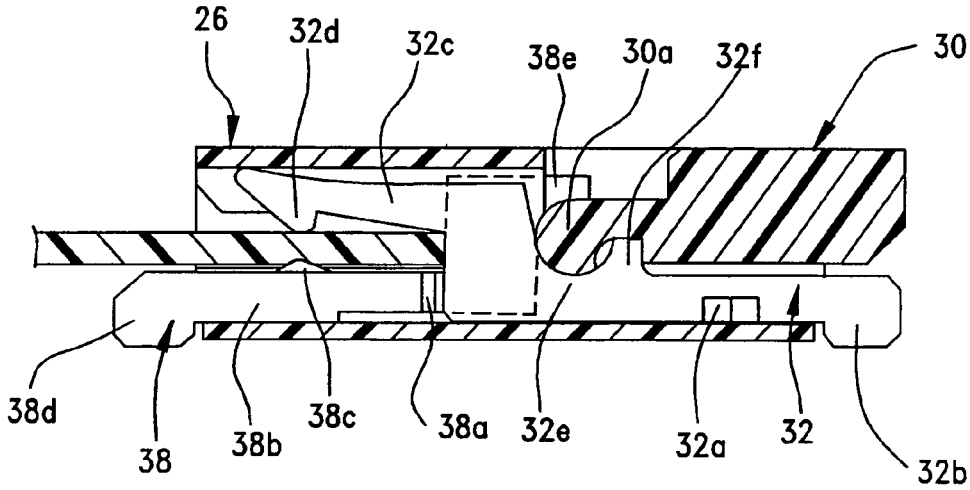
Figure 21:
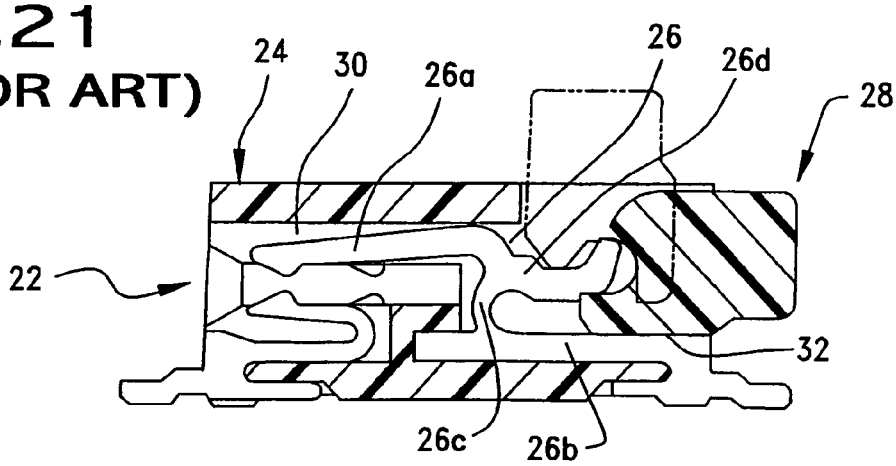
FIG. 21 (PRIOR ART)
FIG. 21 is a sectional view of the prior art connector described in the Background, above.

FIGS. 19 and 20 show a modified embodiment of the invention to illustrate that cam portion 30*a* of actuator 30 can have different cross-sectional configurations. In the embodiment of FIGS. 19 and 20, the cam portion has a more rounded or semi-circular configuration than the oblong or elliptical configuration of the cam portion in the embodiment of FIGS. 1-18*a*. In either embodiment, the cam portion is effectively eccentric in cross-sectional configuration to provide the biasing camming action described in detail above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector (22) for connecting a flat electrical circuit (24) to a printed circuit board, comprising:

a dielectric housing (26) having an opening (28) at a front portion (26*a*) thereof for receiving an end of the flat circuit;

a plurality of terminals (32,38) mounted on the housing in a side-by-side array and spaced along the opening;

an actuator (30) movably mounted for pivotal movement at a rear portion (26*b*) of the housing between an open position allowing the flat circuit to be inserted into said opening and a closed position biasing at least some of the terminals against the flat circuit, the actuator having a cam portion (30*a*) with first (30*b*) and second (30*c*) cam surfaces;

some of said terminals comprising contact terminals (32) having flexible contact arms (32*c*), with opposed first and second edges, the first edge engageable by the first cam surface (30*b*) of the cam portion (30*a*) of the actuator (30) to bias the second edge of the contact arms into engagement with the flat circuit, and tail portions (32*b*) for connection to appropriate circuit traces on the printed circuit board; and some of said terminals comprising pivot/cam terminals (38) having pivot means (42) to mount the actuator for pivotal movement between said open and closed positions, and a cam surface (38*g*) for engaging the second cam surface (30*c*) of the cam portion of the actuator to provide a back-up for the cam portion as the first cam surface (30*b*) of the cam portion biases the flexible contact arms of the contact terminals against the flat circuit.

2. The electrical connector of claim 1 wherein said pivot means of the pivot/cam terminals (38) comprise a pivot socket (42) for receiving the cam portion (30*a*) of the actuator (30) to pivotally mount the actuator for movement between said open and closed positions.

3. The electrical connector of claim 2 wherein said cam surface on the pivot/cam terminals is defined by one side of the pivot socket.

4. The electrical connector of claim 2 wherein said pivot socket (42) has an open mouth (42*a*) to allow the cam portion (30*a*) of the actuator (30) to be positioned thereinto when the actuator is assembled to the housing (26) in its open position.

5. The electrical connector of claim 4 wherein said contact terminals (32) have blocking portions (32*f*) to prevent the cam portion (30*a*) of the actuator (30) from pulling out of the pivot socket (42) when the actuator is in its closed position.

6. The electrical connector of claim 5 wherein said cam portion (30*a*) of the actuator (30) has a narrow dimension in cross-section and a wide dimension generally perpendicular to the narrow dimension, whereby the narrow dimension can pass through the mouth (42*a*) of the pivot socket (42) when the actuator is in its open position, and the blocking portions (32*f*) of the flexible contact terminals (32) prevent the wide dimension from moving out of the mouth when the actuator is in its closed position.

7. The electrical connector of claim 1 wherein the flexible contact arms (32*c*) of said contact terminals (32) engage one side of the flat circuit, and said pivot/cam terminals (38) include generally rigid contact arms (38*b*) for engaging an opposite side of the flat circuit along with tail portions (38*d*) for connection to appropriate circuit traces on the printed circuit board.

8. The electrical connector of claim 7 wherein said pivot/cain terminals (38) are rigidly mounted at a bottom of the housing (26) such that the rigid contact arms (38*b*) are engageable with a bottom side of the flat circuit, and said contact terminals (32) are mounted on the housing with the flexible contact arms (32*c*) located at a top of the housing for engaging a top side of the flat circuit.

9. An electrical connector (22) for terminating a flat electrical circuit (24), comprising:

a dielectric housing (26) having an opening (28) for receiving an end of the flat circuit;

a plurality of terminals (32,38) mounted on the housing in a side-by-side array and spaced along the opening;

an actuator (30) movably mounted on the housing for movement between an open position allowing the flat circuit to be inserted into said opening and a closed position biasing at least some of the terminals against the flat circuit, the actuator having a cain portion (30*a*);

some of said terminals comprising contact terminals (32) having flexible contact arms (32*c*), with opposed first and second edges, the first edge engageable by the cam portion of the actuator to bias the second edge of contact arms into engagement with the flat circuit; and some of said terminals comprising pivot/cam terminals (38) having pivot means (42) to mount the actuator for pivotal movement between said open and closed positions, and a cam surface (38*g*) for engaging the cam portion of the actuator to provide a back-up for the cam portion as the cam portion biases the flexible contact antis of the contact terminals against the flat circuit.

10. The electrical connector of claim 9 wherein said pivot means of the pivot/cam terminals (38) comprise a pivot socket (42) for receiving the cam portion (30*a*) of the actuator (30) to pivotally mount the actuator for movement between said open and closed positions.

11. The electrical connector of claim 10 wherein said cam surface (38*g*) on the pivot/cam terminals (38) is defined by one side of the pivot socket (42).

12. The electrical connector of claim 10 wherein said pivot socket (42) has an open mouth (42*a*) to allow the cam portion (30*a*) of the actuator (30) to be positioned thereinto when the actuator is assembled to the housing (26) in its open position.

13. The electrical connector of claim 12 wherein said contact terminals (32) have blocking portions (32*f*) to prevent the cam portion (30*a*) of the actuator (30) from pulling out of the pivot socket (42) when the actuator is in its closed position.

14. The electrical connector of claim 13 wherein said cw portion (30*a*) of the actuator (30) has a narrow dimension in cross-section and a wide dimension generally perpendicular to the narrow dimension whereby the narrow dimension can pass through the mouth (42*a*) of the pivot socket (42) when the actuator is in its open position, and the blocking portions (32*f*) of the flexible contact terminals (32) prevent the wide dimension from moving out of the mouth when the actuator is in its closed position.

15. The electrical connector of claim 9 wherein the flexible contact arms (32*c*) of said contact terminals (32) engage one side of the flat circuit, and said pivot/cam terminals (38) include generally rigid contact arms (38*b*) for engaging an opposite side of the flat circuit.

16. The electrical connector of claim 15 wherein said pivot/cam terminals (38) are rigidly mounted at a bottom of the housing (26) such that the rigid contact anus (38*b*) are engageable with a bottom side of the flat circuit, and said contact terminals (32) are mounted on the housing with the flexible contact arms (32*c*) located at a top of the housing for engaging a top side of the flat circuit.

* * * * *